US012398621B2

(12) United States Patent
Belshan et al.

(10) Patent No.: US 12,398,621 B2
(45) Date of Patent: Aug. 26, 2025

(54) SYSTEM AND APPARATUS FOR UNLOADING WELL STIMULATION PUMPS

(71) Applicant: SPM Oil & Gas Inc., Fort Worth, TX (US)

(72) Inventors: Daryl James Belshan, Weatherford, TX (US); Bryan Wagner, Aledo, TX (US); Chandu Kumar, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 227 days.

(21) Appl. No.: 17/729,925

(22) Filed: Apr. 26, 2022

(65) Prior Publication Data

US 2023/0340859 A1 Oct. 26, 2023

(51) Int. Cl.

| | |
|---|---|
| ***E21B 34/14*** | (2006.01) |
| ***E21B 43/26*** | (2006.01) |
| ***E21B 47/008*** | (2012.01) |
| ***F04B 1/053*** | (2020.01) |
| ***F04B 15/00*** | (2006.01) |

(52) U.S. Cl.

CPC ..... *E21B 34/14* (2013.01); *E21B 43/26* (2013.01); *E21B 43/2607* (2020.05); *E21B 47/008* (2020.05); *F04B 1/053* (2013.01); *F04B 15/00* (2013.01)

(58) Field of Classification Search

CPC ..... E21B 34/14; E21B 43/26; E21B 43/2607; E21B 47/008; F04B 1/053; F04B 15/00; F04B 49/03

USPC ..... 417/53

See application file for complete search history.

(56) References Cited

U.S. PATENT DOCUMENTS

| | | | | | |
|---|---|---|---|---|---|
| 1,365,272 | A * | 1/1921 | Reeder | F04B 49/243 | 417/294 |
| 1,395,090 | A * | 10/1921 | Carpenter | H02P 1/04 | 417/27 |
| 1,527,954 | A * | 2/1925 | Holdsworth | F04B 49/00 | 137/596.2 |
| 1,602,938 | A * | 10/1926 | Riesner | F04B 49/02 | 417/27 |
| 1,633,035 | A * | 6/1927 | Reck | F04B 49/03 | 417/446 |
| 2,937,801 | A * | 5/1960 | Berkoben | F04B 49/03 | 417/281 |
| 3,077,836 | A * | 2/1963 | Coberly | F04B 53/144 | 251/324 |
| 3,459,363 | A * | 8/1969 | Miller | F04B 49/243 | 417/446 |
| 3,773,438 | A * | 11/1973 | Hall | E21B 43/2607 | 417/345 |

(Continued)

*Primary Examiner* — Mark A Laurenzi
*Assistant Examiner* — Benjamin Doyle

(57) ABSTRACT

An example system includes a fluid end having a block, a suction bore formed in the block, a suction valve seat disposed within the suction bore, and a suction valve disposed within the suction bore, the suction valve, in a closed position, being configured to contact the suction valve seat to seal the suction bore. The system also includes a rod configured to engage the suction valve, the rod being moveable between a first position and a second position, wherein in the first position the suction valve is in the closed position, and in the second position, engagement of the rod with the suction valve causes the suction valve to be in an open position.

20 Claims, 7 Drawing Sheets

(56) References Cited

U.S. PATENT DOCUMENTS

| | | | | |
|---|---|---|---|---|
| 5,356,269 | A * | 10/1994 | Stangroom | F04B 49/243 417/505 |
| 8,366,408 | B2 * | 2/2013 | Wago | F04B 53/1032 417/295 |
| 8,506,262 | B2 * | 8/2013 | Leugemors | F04B 53/1022 417/311 |
| 9,677,558 | B2 * | 6/2017 | Van Himme | F02M 59/48 |
| 10,190,718 | B2 | 1/2019 | Weinstein et al. | |
| 10,550,836 | B2 | 2/2020 | Shampine et al. | |
| 10,683,742 | B2 | 6/2020 | Elmer | |
| 10,850,970 | B2 | 12/2020 | Schmidt | |
| 2001/0036413 | A1 * | 11/2001 | McFadden | E02F 9/2239 417/293 |
| 2003/0010025 | A1 * | 1/2003 | Evans | F16H 61/468 60/431 |
| 2007/0065302 | A1 * | 3/2007 | Schmitz | F04B 39/08 417/298 |
| 2008/0085180 | A1 * | 4/2008 | Mackenzie | F04C 28/08 415/31 |
| 2009/0178387 | A1 * | 7/2009 | Schultz | F02D 19/0642 60/274 |
| 2010/0183448 | A1 * | 7/2010 | Leugemors | F04B 49/22 417/53 |
| 2014/0331659 | A1 * | 11/2014 | Kato | B66F 9/22 60/434 |
| 2014/0361541 | A1 * | 12/2014 | Todd | F03D 15/00 415/4.2 |
| 2020/0182236 | A1 * | 6/2020 | Beisel | F04B 1/053 |
| 2020/0208628 | A1 * | 7/2020 | Sigmar | F04C 11/008 |
| 2020/0256333 | A1 * | 8/2020 | Surjaatmadja | F04B 49/03 |
| 2022/0341202 | A1 * | 10/2022 | Goettl | E04H 4/12 |
| 2023/0332592 | A1 * | 10/2023 | He | F04B 49/22 |

* cited by examiner

SYSTEM AND APPARATUS FOR UNLOADING WELL STIMULATION PUMPS

TECHNICAL FIELD

The present disclosure relates to a pump system. More specifically, the present disclosure relates to a mechanism for maintaining an open position of a valve in a fluid end to unload a well stimulation pump during start up or wind down of a prime mover that drives the well stimulation pump.

BACKGROUND

Hydraulic fracturing is a well stimulation technique that typically involves pumping hydraulic fracturing fluid into a wellbore at a specific rate and pressure necessary to form factures in a rock formation surrounding a targeted region of the wellbore. This well stimulation technique often enhances the natural fracturing of a rock formation in order to increase the permeability of the rock formation, thereby improving recovery of oil, natural gas, and/or other fluids. For example, such techniques are also performed to enhance recovery of water in water wells.

In order to fracture such rock formations, the hydraulic fracturing fluid is injected into the wellbore at high pressures. Typically, a series of pumps are used to achieve such high-pressure injection of the hydraulic fracturing fluid. The series of pumps may be powered by prime movers (e.g., diesel engines, electric motors, natural gas engines, etc.). During a hydraulic fracturing process, several pumps are pumping at the same time with several prime movers powering the pumps. If one of the pumps being used encounters a problem and needs to be shut down, a backup pump can be started to maintain a flow rate of hydraulic fracturing fluid being pumped into the wellbore. Due to the high pressure of the hydraulic fracturing fluid being pumped into the wellbore, prime movers often lack the necessary torque to start a backup pump when the prime mover is operating at a slow speed. Furthermore, with electric motors, starting the backup pump against such a high pressure load leads to a high electrical need which can generate high levels of heat, which can cause additional problems to arise.

An example hydraulic fracturing system is described in U.S. Pat. No. 10,190,718 (hereinafter referred to as "the '718 reference"). In particular, the '718 reference describes an accumulator assembly for a hydraulic fracturing system that is fluidly connectable to a flow line between a blender and a fracturing pump of the hydraulic fracturing system. The '718 reference describes that the accumulator assembly includes a pressurizable tank that contains a pressurized fluid and a control valve fluidly connected to a discharge end of the pressurizable tank and the flow line. The '718 reference describes that the control valve is opened to fluidly connect the pressurizable tank to the flow line when a pressure on the flow line is less than a target pressure. The control valve, described in the '718 reference, is closed when the pressure on the flow line is greater than or substantially the same as the target pressure. However, the '718 reference describes preventing hydraulic fracturing fluid from flowing from a fluid end back to a fluid reservoir. Therefore, the hydraulic fracturing system, described in the '718 reference, maintains a load on the hydraulic fracturing pumps, unless a hydraulic fracturing process is stopped. As such, in order to start prime movers during the hydraulic fracturing process, large amounts of fuel are required to start the prime mover against such a high load and electrical motors would require high power requirements. Furthermore, starting or winding down the prime movers under such a high load could damage or reduce a useful life of a prime mover and/or pumps used in the hydraulic fracturing process.

Example embodiments of the present disclosure are directed toward overcoming the deficiencies described above.

SUMMARY

An example system includes a fluid end having a block, a suction bore formed in the block, a suction valve seat disposed within the suction bore, and a suction valve disposed within the suction bore, the suction valve, in a closed position, being configured to contact the suction valve seat to seal the suction bore. The system also includes a rod configured to engage the suction valve, the rod being moveable between a first position and a second position, wherein in the first position the suction valve is in the closed position, and in the second position, engagement of the rod with the suction valve causes the suction valve to be in an open position.

An example method includes determining to start a prime mover of a fluid system. The method also includes causing one or more suction valves of a fluid end to be positioned in an open position, wherein the one or more suction valves permit fluid to flow from respective pump chambers of the fluid end to a fluid manifold when the one or more suction valves are in the open position. The method may further include receiving, from one or more sensors, sensor data from the fluid system, and determining, based at least in part on the sensor data, that operation of the fluid system satisfies a threshold. The method further includes causing, based at least in part on determining that operation of the fluid system satisfies the threshold, the one or more suction valves to be positioned in a closed position, wherein the one or more suction valves prevent fluid to flow from the respective pump chambers to the fluid manifold when the one or more suction valves are in the closed position.

In a further example, a system includes a fluid end having a block, a suction bore formed in the block, a suction valve seat disposed within the suction bore, and a suction valve disposed within the suction bore, the suction valve configured to contact the suction valve seat in a closed position to seal the suction bore. The system further includes a controller configured to position the suction valve in the open position or allow it to be in the closed position, wherein the controller is configured to position the suction valve in the open position for an amount of time, the suction valve being substantially static in the open position for the amount of time.

DETAILED DESCRIPTION

Figure 1:
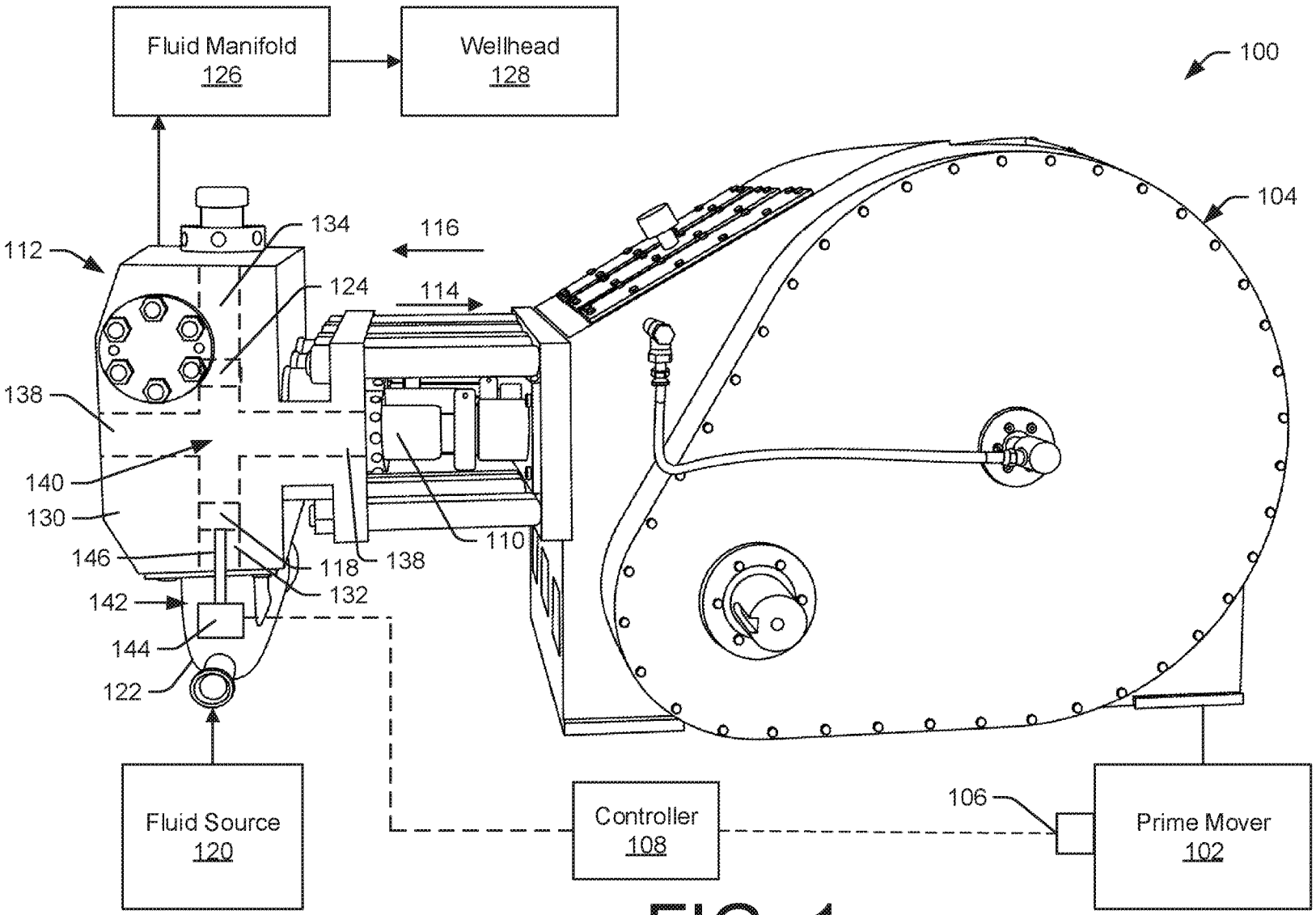
FIG. 1 is a partial schematic view of an example fluid system having an unloading mechanism, in accordance with an example of the present disclosure.

FIG. 1 depicts an example fluid system 100. The fluid system 100 shown in FIG. 1 is part of a well service, workover, or well stimulation system for an oil and gas well. For example, the fluid system 100 is implemented in a hydraulic fracturing system, which is a well stimulation technique that involves pumping hydraulic fracturing fluid into a wellbore at a rate and pressure sufficient to form fractures in a rock formation surrounding the wellbore. In some examples, the fluid system 100 shown in FIG. 1 forms a portion of a hydraulic fracturing system or other well service system and may include additional and/or alternative components than the components shown and described in FIG. 1.

In some examples, the fluid system 100 includes at least one prime mover 102 coupled to a pump 104. The prime mover 102 is coupled to the pump 104 and is configured to drive operation of the pump 104. As such, the prime mover 102 may also be referred to herein as a "driver." In some examples, the prime mover 102 may be a diesel engine, natural gas engine, or other type of internal combustion engine. Alternatively, the prime mover 102 may be an electric motor. In some examples, the prime mover 102 may include one or more sensors 106 that sense and generate driver speed data. The driver speed data may be sent to a controller 108 of the fluid system 100. The one or more sensors 106 may also generate and communicate load data or other types of data to the controller 108.

In some examples, the fluid system 100 may include multiple controllers 108 that receive data from the fluid system 100 and are configured to control at least a portion of the operations of the fluid system 100 automatically and/or with user input, as will be described further herein. While the description herein may describe a single controller 108, it is to be understood that multiple controllers 108 may be used to perform the actions described herein.

In some examples, the controller 108 may be a manually operated and/or actuated controller. For example, the controller 108 may include a push button actuator, switch (e.g., pneumatic switch, electronic switch, mechanical switch, etc.), lever, or other manually operated controller that is configured to control at least a portion of the operations of the fluid system 100. In some examples, and as described further herein below, a user (such as an operator) may operate the controller 108 which may, in turn, be configured to operate an unloading mechanism 142 (described further herein below) of the fluid system 100. While the controller 108 is described as being configured to control at least a portion of the operations of fluid system 100, it is to be understood that a user may manually control such operations of the controller 108.

Additionally, or alternatively, the controller 108 may be, for example, a hardware electronic control module (ECM) or other electronic control unit (ECU). The controller 108 includes, for example, a microcontroller, one or more processors, memory (e.g., RAM), storage (e.g., EEPROM or Flash) configured to perform the described functions of the controller 108. The controller 108 controls at least a portion of the operations of the fluid system 100 automatically and/or with user input. Instead of, or in addition to, an ECM/ECU the controller 108 may include a general computer microprocessor configured to execute computer program instructions (e.g., an application) stored in memory to perform the disclosed functions of the controller 108. As mentioned, the controller 108 includes a memory, a secondary storage device, processor(s), and/or any other computing components for running an application. Various other circuits may be associated with controller 108 such as power supply circuitry, signal conditioning circuitry, solenoid driver circuitry, actuator driver circuitry, or other circuitry. In some examples, the controller 108 and/or a portion of components of the controller 108 may be located remotely from the fluid system 100 and may be communicatively coupled to the fluid system 100.

As mentioned previously, the controller 108 may receive various types of data from components of the fluid system 100. Furthermore, the controller 108 may provide instructions to the various components of the hydraulic fracturing system 100. For example, the controller 108 may receive driver speed data from a driver speed sensor 106 of the prime mover 102. The controller 108 may also provide operational instructions to the prime mover 102, and in some examples, the controller 108 may generate such instructions based on information received from the sensor 106 and/or based on other information (e.g., one or more control maps, algorithms, or rules stored in the memory noted above). In any of the examples described herein, the controller 108 may be configured to control operation of the prime mover 102 during various tasks performed by the fluid system 100. For example, the controller 108 may be configured to start up or wind down the prime mover 102.

The prime mover 102 may be directly or indirectly coupled to the pump 104 and may be configured to drive the pump 104. In some examples, the pump 104 may be a hydraulic fracturing pump (or other type of well service or workover pump). The pump 104 may include various types of high-volume hydraulic fracturing pumps such as triplex pumps, quintuplex pumps, or other types of hydraulic fracturing pumps. Additionally, and/or alternatively, the pump 104 includes other types of reciprocating positive-displacement pumps or gear pumps. A number of pumps implemented in the fluid system 100 and designs of the pump 104 (or pumps) may vary depending on the fracture gradient of the rock formation that will be hydraulically fractured, the number of pumps 104 used in a fluid system 100, the flow rate necessary to complete the hydraulic fracture, the pressure necessary to complete the hydraulic fracture, etc. The fluid system 100 includes any number of pumps 104 in order to pump hydraulic fracturing fluid at a predetermined rate and pressure. The exact configuration of the fluid system 100 varies from site to site.

The pump 104 includes at least one plunger 110 that is at least partially disposed within a fluid end 112. In some examples, the pump 104 includes multiple plungers 110 disposed within the fluid end 112. When the pump 104 is operating, the pump 104 drives the plunger 110 in reciprocating motion. For example, the pump 104 moves the plunger 110, at least partially within the fluid end 112, in a first direction 114 and a second direction 116 that is opposite the first direction 114. In some examples, the pump 104 may be configured to move the plunger 110 in reciprocal directions in order to allow fluid into the fluid end 112 and pump the fluid out of the fluid end 112. For example, when the pump 104 moves the plunger 110 in the first direction 114, the plunger 110 allows fluid to flow through a suction valve 118 (shown further in FIG. 3) into the fluid end 112 from a fluid source 120. The fluid source 120 is fluidly connected to a fluid intake manifold 122 configured to distribute hydraulic fracturing fluid to one or more chambers within the fluid end 112. Additionally, or alternatively, the fluid source 120 includes one or more water tanks, blenders, hydration units, liquid additive systems, etc.

Furthermore, when the pump 104 moves the plunger 110 in the second direction 116, the plunger 110 displaces the fluid, increasing a pressure of the fluid, until the fluid reaches a predetermined pressure. Once the fluid reaches the predetermined pressure, a discharge valve 124 (shown further in FIG. 3) within the fluid end 112 opens and allows the fluid to move from the fluid end 112 into a fluid discharge manifold 126. In some examples, the fluid discharge manifold 126 receives pressurized fluid from one or more fluid ends and directs the fluid to a wellhead 128 where the fluid is injected into a wellbore.

In some examples, the fluid end 112 includes a block 130 having one or more bores (or fluid passages) formed in the block 130 of the fluid end 112. The block 130 may be formed from stainless steel, carbon steel, or other material. In some examples, the fluid end 112 includes a suction bore 132 formed in the block 130. The suction bore 132 provides a fluid passageway for fluid to enter the fluid end 112 when the plunger 110 moves in the first direction 114. The suction bore 132 includes the suction valve 118 disposed within the suction bore 132. The suction valve 118 is configured to control flow of fluid into the fluid end 112. For example, when the plunger 110 moves in the first direction 114, the movement of the plunger 110 causes the pressure of the fluid in the pump chamber 140 to be lower than the pressure of the fluid in the suction bore 132 which causes the suction valve 118 to open, thereby allowing fluid into the fluid end pump chamber 140. Conversely, when the plunger 110 moves in the second direction 116, the suction valve 118 remains closed, allowing the plunger 110 to displace the fluid within the fluid end 112.

The fluid end 112 also includes a discharge bore 134 formed in the block 130. The discharge bore 134 provides a fluid passageway for fluid to be discharged from the fluid end 112 to the fluid discharge manifold 126 (or other component). The discharge bore 134 includes a discharge valve 124 disposed within the discharge bore 134. The discharge valve 124 is configured to control fluid flow from the fluid end 112. For example, the discharge valve 124 remains closed until the fluid has reached a predetermined pressure as the plunger 110 displaces the fluid by moving in the second direction 116. Once the fluid reaches the predetermined pressure, the pressurized fluid causes the discharge valve 124 to open, allowing the fluid to be discharged from the fluid end 112.

The fluid end 112 further includes a plunger bore 136 formed in the block 130. The plunger bore 136 is sized to receive the plunger 110 of the pump 104 at least partially therein. As mentioned previously, the plunger 110 is moveable in the first direction 114 and the second direction 116 within the plunger bore 136 to allow fluid into the fluid end 112 via the suction bore 132 and discharge the fluid from the fluid end 112 via the discharge bore 134. The fluid end 112 further includes a suction cover bore 138 formed in the block 130 of the fluid end 112. The suction cover bore 138 remains sealed during operation of the pump 104. However, the suction cover bore 138 provides access to the plunger 110 or portions of the fluid end 112 for maintenance or other reasons, while the pump 104 is not operating.

The fluid end 112 also includes a pump chamber 140 disposed between the suction bore 132 and the discharge bore 134. The pump chamber 140 is a chamber formed in the fluid end 112 that is formed at least in part by a convergence of portion(s) of the suction bore 132, the discharge bore 134, the plunger bore 136, and the suction cover bore 138. In some examples, the plunger 110 displaces the fluid in the pump chamber 140 until it reaches a predetermined pressure, which causes the discharge valve 124 to open, allowing the fluid to exit the pump chamber 140 via the discharge valve 124.

The fluid system 100 further includes an unloading mechanism 142. The unloading mechanism 142 may be configured to maintain the suction valve 118 in an open position while the prime mover 102 starts up, winds down, or otherwise operates. Maintaining the suction valve 118 in the open position while the pump 104 operates permits fluid to circulate between the pump chamber 140 and the fluid intake manifold 122. Additionally, the unloading mechanism 142 may prevent fluid flow through an outlet (e.g., outlet 318 in FIG. 3) of the fluid end 112 while the prime mover 102 is still winding down. The unloading mechanism 142 may include an actuator 144 coupled to a rod 146 and configured to move the rod 146 between various positions. For example, the actuator 144 may extend the rod 146 which may press against the suction valve 118, thereby lifting the suction valve 118 and positioning the suction valve 118 in an open position. Conversely, the actuator 144 may retract the rod 146 such that the rod 146 allows the suction valve 118 to be positioned in a closed position. The actuator 144 may include an electronic actuator, a hydraulic actuator, a pneumatic actuator, or other type of actuator configured to actuate the rod 146. In some examples, the unloading mechanism 142 is communicatively coupled to the controller 108. For example, the controller 108 may be configured to control actuation of the actuator 144. As such, the controller 108 may be configured to position the suction valve 118 in an open position or a closed position via actuation of the actuator 144. In some examples, the controller 108 sends one or more signals to the actuator 144 which causes the actuator 144 to extend or retract the rod 146, thereby causing the suction valve 118 to open or close.

In some examples, the system 100 may include multiple unloading mechanisms 142 that correspond with a number of suction valves 118 in the fluid end 112. In other words, the system 100 may include an unloading mechanism 142 for each suction valve 118 in the fluid end 112. In some examples, individual unloading mechanisms 142 may be configured to position individual suction valves 118 independent of other unloading mechanisms 142. However, operation of the unloading mechanisms 142 may be coordinates such that the unloading mechanisms 142 open and close the suction valves 118 sequentially or simultaneously. In some examples, the unloading mechanisms 142 As such, the unloading mechanisms 142 are configured to close or open the suction valves 118 in a specific sequence in order to reduce a rate of load being applied to the prime mover 102 during operation of the pump 104. Control of the unloading mechanisms 142, either in sequence or substantially synchronous, may be controlled by the controller 108. As described further herein, the controller 108 may include an electronic controller and/or the controller 108 (e.g., such as a lever, switch, or other manually controlled apparatus) may be manually controlled.

In some examples, the controller 108 receives driver speed data from the one or more sensors 106 of the prime mover 102. The driver speed data is indicative of a driver speed (e.g., engine or motor speed) of the prime mover 102. The controller 108 may be configured to control operation of the unloading mechanism 142 based at least in part on the driver speed data. For example, the controller 108 may be configured to position the suction valve 118 in an open position when the driver speed data indicates that the driver speed is below a threshold driver speed. However, in some examples, the controller 108 is configured to position the suction valve 118 in an open position or a closed position irrespective of the driver speed. For example, a user may manually operate the controller 108, thereby causing the controller 108 to position the suction valve in the open position or the closed position. As mentioned previously, while the controller 108 is described as positioning the suction valve 118 in the open position or the closed position, it is to be understood that a user may manually control such operations. In some instances, when the driver speed is below a threshold driver speed, the prime mover 102 may be starting up or winding down. As such, the controller 108 may open the suction valve 118 in order to unload the pump 104. For example, opening the suction valve 118 while the prime mover 102 starts up or winds down allows the prime mover 102 to start or wind down under a reduced load. For example, rather than having to pump fluid to a predetermined pressure to discharge fluid through the discharge valve 124, the fluid is circulated between the pump chamber 140 and the fluid intake manifold 122. In some examples, the controller 108 may open the suction valve 118 for an amount of time associated with a time between starting the prime mover 102 and the driver speed of the prime mover 102 reaching the threshold driver speed.

In some examples, the controller 108 is configured to allow the suction valve 118 to move to a closed position when the driver speed data indicates that the driver speed is substantially equal to or greater than the threshold driver speed. In some instances, once the driver speed reaches the threshold driver speed, the prime mover 102 may be capable of driving operation of the pump 104 at a required torque, pump speed, pump rate, or other parameter. Once the controller 108 allows the suction valve 118 to move to the closed position while the pump 104 is operating, the suction valve 118 may resume "normal operation." For example, under "normal operation" when the pump 104 moves the plunger 110 in the first direction 114, the pressure in the pump chamber 140 may become lower than the pressure of the fluid in the intake manifold 122, which causes the suction valve 118 to open allowing fluid through the suction valve 118 into the fluid end 112 from a fluid source 120. When the plunger 110 begins to move in the second direction 116, the suction valve 118 may close, preventing fluid from returning through the suction bore 132. As such, the actuator 144 may be configured to retract the rod 146 such that the suction valve 118 is able to resume "normal operation" unimpeded by the unloading mechanism 142.

Additionally, or alternatively, the controller 108 may open the suction valve 118 once the driver speed of the prime mover 102 is below the threshold driver speed and the amount of time is a time between the driver speed passing below the threshold driver speed and the driver speed reaching a driver speed of approximately 0 revolutions per minute (RPM) (or other secondary threshold speed). Starting or winding down the prime mover 102 under a reduced load may significantly reduce fuel consumption, reduce electrical power requirements, allow the prime mover 102 to reach a rated speed and torque before being loaded, and may extend a life of the prime mover 102 and/or pump 104, among other potential benefits.

Figure 2:
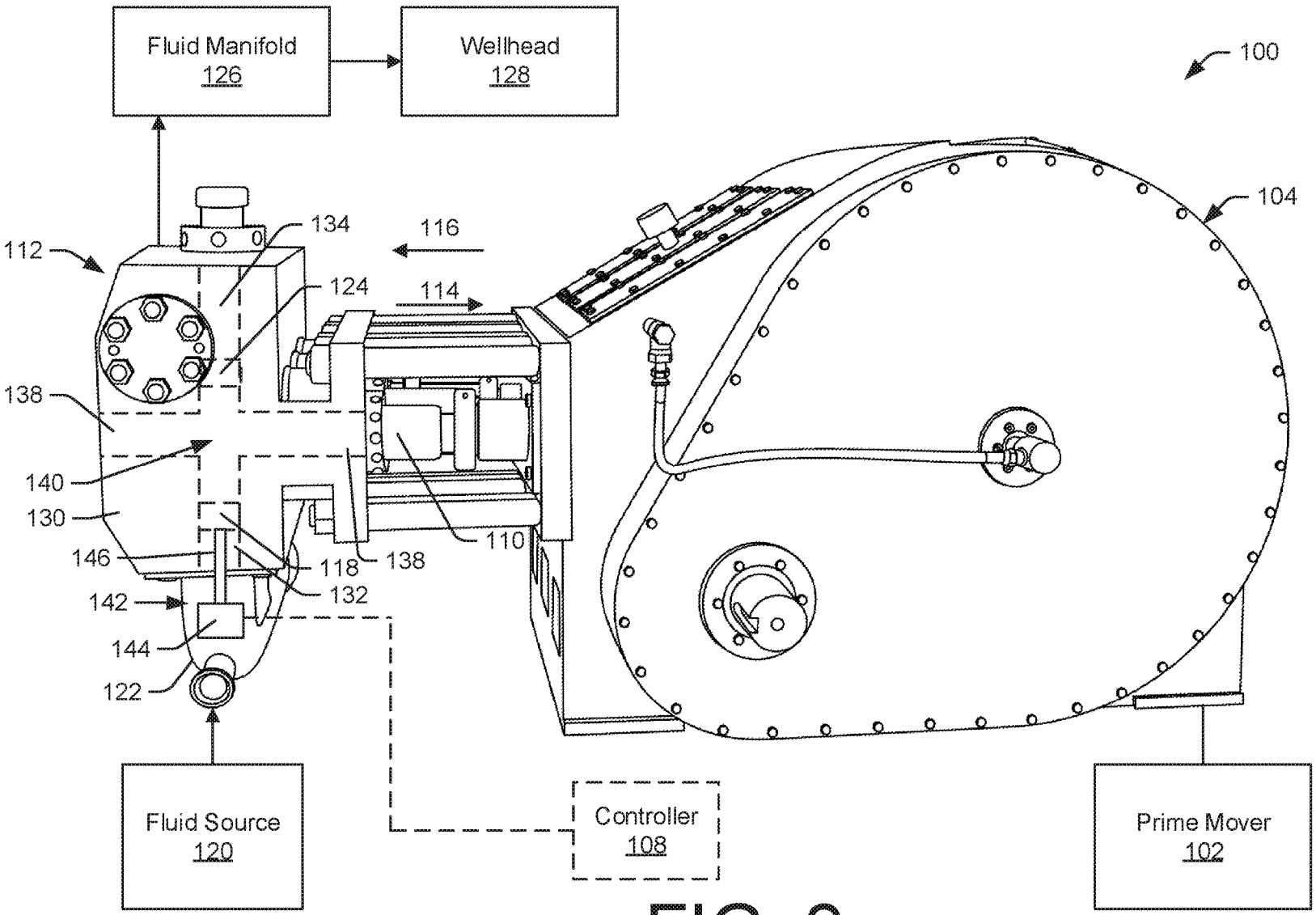
FIG. 2 is a partial schematic view of another example fluid system having an unloading mechanism, in accordance with an example of the present disclosure.

FIG. 2 depicts the example fluid system 100. The fluid system 100 may be substantially the same as the fluid system 100 shown and described with respect to FIG. 1. However, as shown in FIG. 2, the controller 108 in FIG. 2 may be a manually operated and/or actuated controller and may be operable irrespective of the prime mover 102. As such, the controller 108 may not need to be communicatively coupled to the prime mover 102 and/or sensors associated with the prime mover 102. For example, the controller 108 may include a push button actuator, switch (e.g., pneumatic switch, electronic switch, mechanical switch, etc.), lever, or other manually operated controller that is configured to control at least a portion of the operations of the fluid system 100.

In some examples, a user (such as an operator) may operate the controller 108 which may, in turn, be configured to operate the unloading mechanism 142 of the fluid system 100. For example, a user may determine to operate the controller 108 while the prime mover 102 starts up, winds down, or during any other portion of operation of the fluid system 100. In some examples, when the user operates (e.g., actuates a switch, presses a button, or otherwise operates and/or actuates the controller 108) the controller 108 may cause one or more signals to be sent to the actuator 144 that is coupled to the rod 146 and the one or more signals may cause the actuator 144 to actuate the rod 146 between various positions. Additionally, or alternatively, when the user operates the controller 108, the controller may be configured to manually engage the actuator 144 or the rod 146, thereby causing the actuator 144 to acuate the rod 146 between various positions or to directly engage and move the rod 146 between various positions. Furthermore, in some examples, the controller 108 may be omitted and a user may directly control actuation 144 of the actuator via various input methods.

Figure 3:
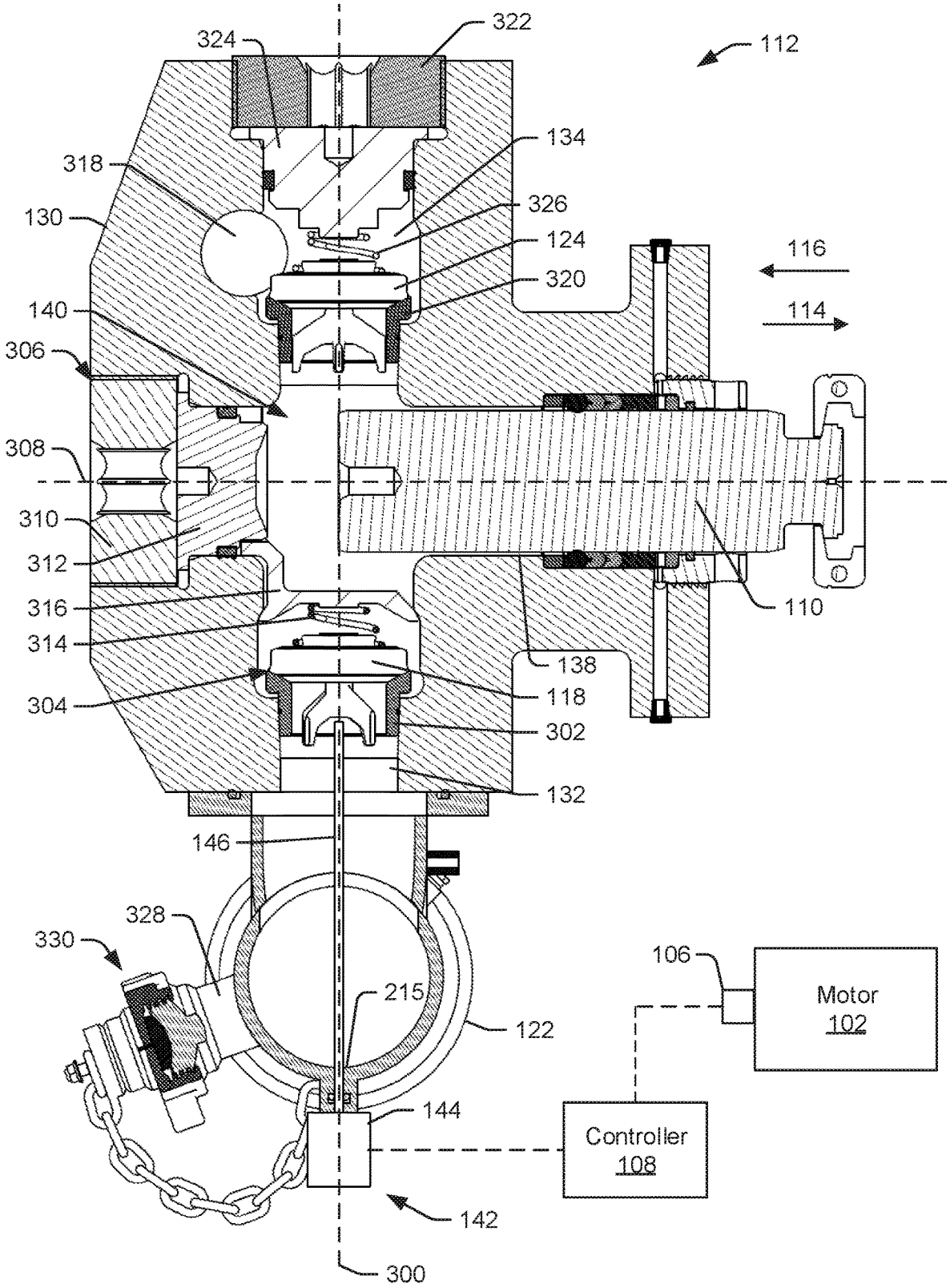
FIG. 3 is a cross-sectional view of an example fluid end with an unloading mechanism in a first position, in accordance with an example of the present disclosure.

FIG. 3 depicts a cross-sectional view of the fluid end 112 with the unloading mechanism 142 positioning the suction valve 118 in a closed position. As described previously, the fluid end 112 includes the block 130 having one or more bores formed in the block 130 of the fluid end 112. For example, the fluid end 112 includes the suction bore 132 formed in the block 130 and defined along a first axis 300. In some examples, the suction bore 132 provides a fluid passageway extending from an exterior surface of the block 130 to the pump chamber 140. The suction bore 132 allows fluid to enter the fluid end 112 when the plunger 110 moves in the first direction 114, allowing fluid into the pump chamber 140 of the fluid end 112.

The fluid end 112 includes a suction valve 118 disposed within the suction bore 132 that is configured to control fluid flow through the suction bore 132. The suction bore 132 also includes a suction valve seat 302 disposed within the suction bore 132. The suction valve seat 302 provides a surface against which the suction valve 118 rests when the suction valve 118 is positioned in a closed position 304. When the suction valve 118 is in the closed position 304, the suction valve 118 creates a fluid seal between the suction valve 118 and the suction valve seat 302. As such, the suction valve 118 prevents fluid to flow from the pump chamber 140 of the fluid end 112 to the fluid intake manifold 122 when the suction valve 118 is positioned in the closed position 304.

The fluid end 112 includes a suction cover bore 306 formed in the block 130 of the fluid end 112 and extending along a second axis 308. In some examples, the fluid end 112 includes a suction cover 312 and a suction cover retainer 310 that are disposed at least partially within the suction cover bore 306. The fluid end 112 may include a spring 314 (or other biasing member) disposed between the suction valve 118 and a suction valve retainer 316. The suction valve retainer 316 is configured to maintain a position of the spring 314 such that the spring exerts a force on the suction valve 118 to maintain the suction valve in the closed position 304. In some examples, when the plunger 110 moves in the first direction 114, the plunger 110 creates negative pressure within the pump chamber 140 that overcomes the biasing force exerted on the suction valve 118 by the spring 314, thereby opening the suction valve 118.

Figure 4:
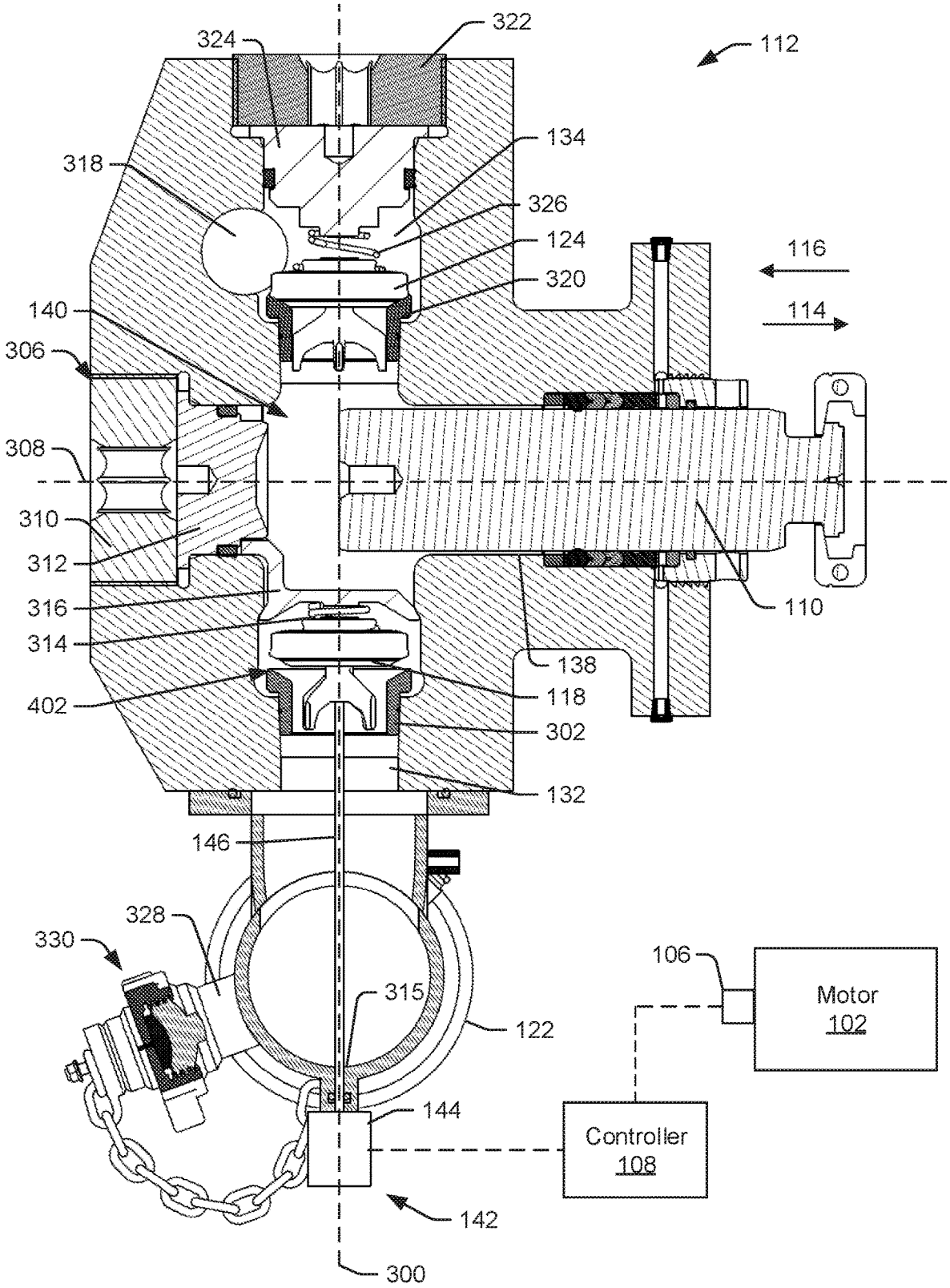
FIG. 4 is a cross-sectional view of an example fluid end with an unloading mechanism in a second position, in accordance with an example of the present disclosure.

As described previously, the system 100 includes an unloading mechanism 142 that is configured to allow the position of the suction valve 118 to be in the closed position 304 or an open position (as shown in FIG. 4). The unloading mechanism 142 may be configured to maintain the suction valve 118 in an open position while the prime mover 102 starts up, winds down, or otherwise operates. However, once the prime mover 102 reaches a threshold speed, the unloading mechanism 142 may allow the suction valve 118 to resume "normal operation," allowing a pressure differential induced by the plunger 110, as the plunger 110 moves in reciprocating motion, to open and close the suction valve 118. The unloading mechanism 142 may include an actuator 144 coupled to a rod 146 and configured to move the rod 146 between various positions. As shown in FIG. 3, the rod 146 is positioned in a retracted position (or a first position). In the retracted position, the rod 146 may be disposed proximate the suction valve 118 (e.g., being spaced therefrom) and/or may contact the suction valve 118. In the retracted position, the suction valve 118 is positioned in the closed position 304.

In some examples, the actuator 144 may be coupled to an exterior surface of the fluid intake manifold 122 and the rod 146 may be coupled to the actuator 144 and may extend through an aperture 315 formed in the fluid intake manifold 122. In some examples, the rod 146 may extend from the actuator 144 to a location proximate the suction valve 118. In some examples, the rod 146 is coupled to the suction valve 118. In some instances, the rod 146 includes an elongated rigid and/or semi-rigid rod. The rod 146 may comprise a metallic material such as aluminum, steel, stainless steel, or other metallic material.

In some examples, the unloading mechanism 142 is communicatively coupled to the controller 108. For example, the controller 108 may be communicatively coupled to the actuator 144 and is configured to control actuation of the actuator 144. As such, the controller 108 may be configured to position the suction valve 118 in an open position or the closed position 304 via actuation of the actuator 144, which moves the rod 146 between retracted position and an extended position (or a second position). In some examples, the controller 108 sends one or more signals to the actuator 144 to cause the actuator 144 to extend or retract the rod 146, thereby causing the suction valve 118 to open or close.

As described previously, the controller 108 receives driver speed data from the one or more sensors 106 of the prime mover 102. The driver speed data may be indicative of a driver speed of the prime mover 102. The controller 108 may be configured to control operation of the unloading mechanism 142 based at least in part on the driver speed data. For example, the controller 108 is configured to position the suction valve 118 in the closed position 304 when the driver speed data indicates that the driver speed is substantially equal to or greater than the threshold driver speed. In some instances, once the driver speed reaches the threshold driver speed, the prime mover 102 may be capable of driving operation of the pump 104 at a required torque, pump speed, pump rate, or other parameter. Once the controller 108 positions the suction valve 118 in the closed position while the pump 104 is operating, the suction valve 118 may resume "normal operation." However, in some examples, the controller 108 may be manually operated by a user that operates the controller 108 to control operation of the unloading mechanism 142. Furthermore, the controller 108 may receive additional sensor data from one or more other sensors of the system 100. For example, the system 100 may receive pressure data associated with one or more components of the system, load data associated with the pump 104 and/or the prime mover 102, and/or other data associated with the system 100. The controller 108 may control operation of the unloading mechanism 142 based at least in part on the additional sensor data in addition to or instead of the driver speed data.

The fluid end 112 further includes a discharge bore 134 formed in the block 130 and extending approximately along the first axis 300. The discharge bore 134 forms a fluid passageway extending between an exterior surface of the block 130 and the pump chamber 140. The discharge bore 134 allows fluid to be discharged from the fluid end 112 to a fluid discharge manifold 126 via an outlet 318 of the fluid end 112. The fluid end 112 includes a discharge valve 124 disposed within the discharge bore 124 that is configured to control fluid flow through the discharge bore 134. The discharge bore 134 also includes a discharge valve seat 320 disposed within the discharge bore 134. In some examples, the discharge valve seat 320 provides a surface against which the discharge valve 124 rests when the discharge valve 124 is closed, creating a fluid seal between the discharge valve 124 and the discharge valve seat 320. In some examples, when the plunger 110 moves in the second direction 116, the plunger 110 displaces the fluid within the pump chamber 140 until a pressure of the fluid within the pump chamber 140 reaches and/or exceeds a threshold pressure, thereby forcing the discharge valve 124 to unseat (e.g., lift), opening the discharge valve 124. The plunger 110 directs the fluid out of the outlet 318 of the fluid end 112 and into a fluid discharge manifold 126 or other component.

In some examples, the discharge bore 134 further includes a discharge cover 324 and a discharge cover retainer 322 that are disposed at least partially within the discharge bore 134. The discharge cover 324 and the discharge cover retainer 322 cause fluid that flows through the discharge valve 124 to flow out of the fluid end 112 via the outlet 318. The fluid end 112 may include a spring 326 (or other type of biasing member) that is disposed between the discharge valve 124 and the discharge cover 324. The spring 326 is configured to maintain the discharge valve in a closed position 304 (as illustrated in FIG. 3) until the fluid within the pump chamber 140 reaches and/or exceeds a threshold pressure. That is, the spring 326 exerts a force on the discharge valve 124 in the closed position. Once the fluid is displaced to the threshold pressure, the fluid overcomes the biasing force exerted on the discharge valve 124 by the combined forces of the spring 326 and the existing pressure within the discharge bore 134.

The fluid end further includes the plunger bore 138 formed in the block 130 and extending approximately along the second axis 308 that may be substantially perpendicular to the first axis 300. The plunger bore 138 is sized to receive the plunger 110 of the pump 104 at least partially within the plunger bore 110. Furthermore, the plunger bore 138 is sized to allow the plunger 110 to move in the first direction 114 and the second direction 116 at least partially within the plunger bore 138 to allow fluid into the fluid end 112 via the suction bore 132, displace the fluid in the pump chamber 140, and discharge the fluid from the fluid end 112 via the discharge bore 134.

In some examples, the fluid intake manifold 122 may include a port 328 formed in the fluid intake manifold 122. The port 328 may include a cap 330 that is configured to fluidly seal the port 328 when the cap 330 is coupled to the port 328. In some examples, the cap 330 may be removed from the port 328 to allow fluid to drain out of the fluid intake manifold 122.

As mentioned previously, the unloading mechanism 142 may be configured to maintain the suction valve 118 in an open position while the prime mover 102 starts up, winds down, or otherwise operates. However, once the prime mover 102 reaches a threshold speed, the unloading mechanism 142 may allow the suction valve 118 to resume "normal operation," allowing the plunger 110 to open and close the suction valve 118 as the plunger 110 moves in reciprocating motion. According to the present disclosure, the pump 104 (e.g., including the unloading mechanism 142) may be operated independently of system pressure (e.g., fluid pressure downstream of the pump 104). Therefore, the prime mover 102, associated with the pump 104, may be accelerated to an operating speed and operating torque against a reduced load that is less than an operating load that corresponds to system pressure. Starting or winding down the prime mover 102 under the reduced load may significantly reduce fuel consumption, reduce electrical power requirements, and may extend a life of the prime mover 102 and/or pump 104, among other potential benefits.

FIG. 4 depicts a cross-sectional view of the fluid end 112 with the unloading mechanism 142 positioning the suction valve 118 in an open position 402. In some examples, the unloading mechanism 142 is configured to maintain the suction valve 118 in the open position 402 while the prime mover 102 starts up, winds down, or is otherwise operating below a threshold driver speed. Maintaining the suction valve 118 in the open position 402, during operation of the pump 104, opens two-way fluid circulation (e.g., through the suction bore 132) between the pump chamber 140 and the fluid intake manifold 122 (and/or the fluid source 120). For example, in contrast to normal operation, when the off-loading mechanism 142 causes the suction valve 118 to be positioned in the open position 402, fluid may flow back from the pump chamber 140 to the fluid intake manifold 122 open position 402. The unloading mechanism 142 may include an actuator 144 coupled to a rod 146 and configured to move the rod 146 between various positions. For example, the actuator 144 may extend the rod 146 which may press against the suction valve 118, thereby lifting the suction valve 118 and positioning the suction valve 118 in the open position 402.

In some examples, the controller 108 receives driver speed data from the one or more sensors 106 of the prime mover 102. The driver speed data is indicative of a driver speed of the prime mover 102. The controller 108 may be configured to control operation of the unloading mechanism 142 based at least in part on the driver speed data. For example, the controller 108 may be configured to position the suction valve 118 in the open position 402 when the driver speed data indicates that the driver speed is below a threshold driver speed. However, in some examples, the controller 108 may be manually operated by a user that operates the controller 108 to control operation of the unloading mechanism 142. In some instances, when the driver speed is below a threshold driver speed, the prime mover 102 may be starting up or winding down. As such, the controller 108 may open the suction valve 118 in order to unload the pump 104 for an amount of time necessary for the prime mover 102 to reach the threshold driver speed. For example, positioning the suction valve 118 in the open position 402 while the prime mover 102 starts up or winds down allows the prime mover 102 to start or wind down under a reduced load. In some examples, rather than having to pump fluid to a predetermined pressure to discharge fluid through the discharge valve 124, the fluid is circulated between the pump chamber 140 and the fluid intake manifold 122 (and/or the fluid source 120) as the plunger 110 moves in reciprocal motion within the plunger bore 138. Starting or winding down the prime mover 102 under a reduced load may significantly reduce fuel consumption, reduce electrical power requirements, and may extend a life of the prime mover 102 and/or pump 104, among other potential benefits. The controller 108 may be configured to allow the position of the suction valve 118 in the closed position 304 once the driver speed reaches and/or exceeds the threshold driver speed.

Figure 5:
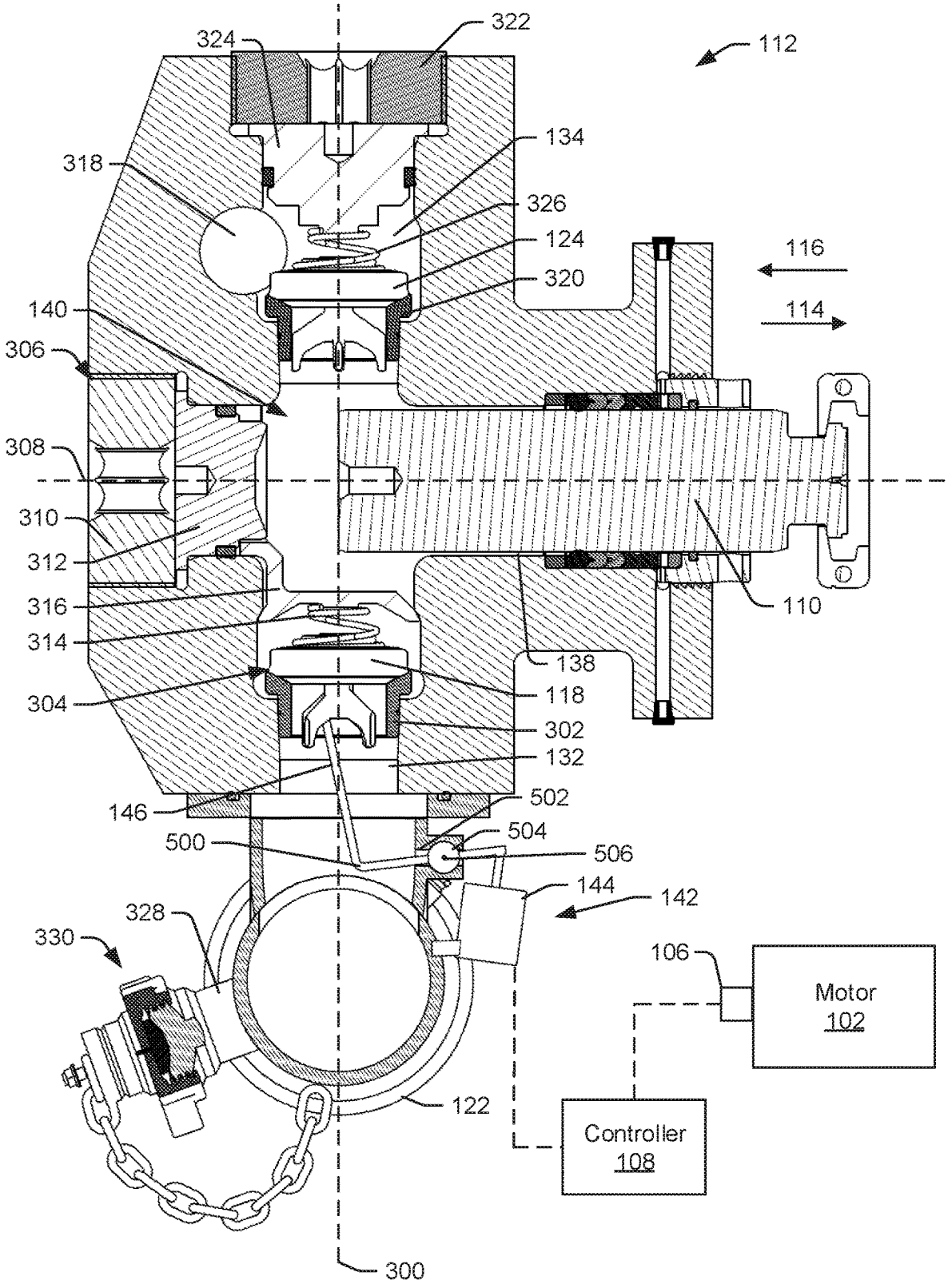
FIG. 5 is a cross-sectional view of an example fluid end with an alternate embodiment of an unloading mechanism in a first position, in accordance with an example of the present disclosure.

FIG. 5 is a cross-sectional view of the fluid end 112 with an alternate example of the unloading mechanism 142 that is configured to position the suction valve 118. The unloading mechanism 142 may be configured to maintain the suction valve 118 in an open position while the prime mover 102 starts up, winds down, or otherwise operates. However, once the prime mover 102 reaches a threshold speed, the unloading mechanism 142 may allow the suction valve 118 to resume "normal operation," allowing the plunger 110 to open and close the suction valve 118 as the plunger 110 moves in reciprocating motion.

In some examples, the unloading mechanism 142 shown in FIG. 5 may include an actuator 144. In some examples, the actuator 144 may be coupled to an exterior surface of the fluid intake manifold 122. Furthermore, the actuator 144 may be coupled to a surface of the fluid intake manifold 122 on a side of the fluid intake manifold 122 that is opposite the port 328 of the fluid intake manifold 122. The actuator 144 may include an electronic actuator, a hydraulic actuator, or other type of actuator configured to actuate the rod 146. The actuator 144 may be coupled to the rod 146 and is configured to move the rod 146 between various positions. As shown in FIG. 5, the rod 146 is positioned in an extended position. In the extended position, the rod 146 may be disposed proximate the suction valve 118 and/or may contact the suction valve 118. In either instance, in the extended position, the rod 146 the suction valve 118 is positioned in the closed position 304.

In some instances, the rod 146 includes an elongated rigid and/or semi-rigid rod. The rod 146 may comprise a metallic material such as aluminum, steel, stainless steel, or other metallic material. As shown in FIG. 5, the rod 146 may include one or more bends 500 formed in the rod 146 and/or the rod 146 may be formed from multiple sections that are coupled together. In either example, the rod 146 extends from the actuator 144 through an aperture 502 formed in the fluid intake manifold 122 and to a location proximate and/or in contact with the suction valve 118.

In some examples, a portion of the rod 146 is secured within a joint 504. The joint 504 may be disposed at least partially within the aperture 502 in the fluid intake manifold 122. The joint 504 may allow the rod 146 to move in one or more directions within the joint 504. For example, the joint 504 may allow the rod 146 to move rotationally around a central axis 506 of the joint 504. The joint 504 may include a pivot join, ball joint, or other type of joint. In some examples, the joint 504 provides a pivot point about which the rod 146 is moveable when the actuator 144 causes movement of the rod 146.

Figure 6:
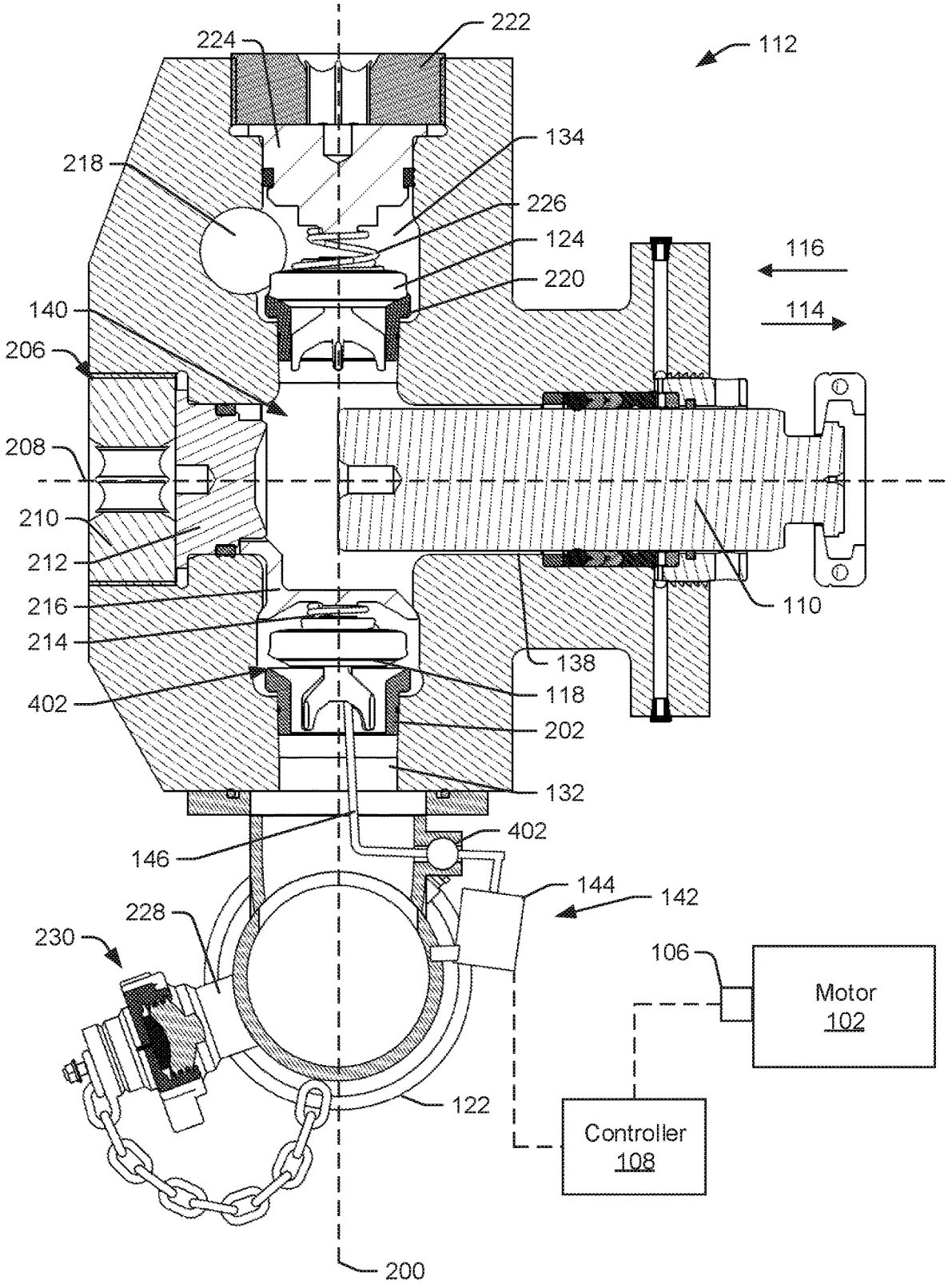
FIG. 6 is a cross-sectional view of an example fluid end with an alternate embodiment of an unloading mechanism in a second position, in accordance with an example of the present disclosure.

In some examples, the unloading mechanism 142 is communicatively coupled to the controller 108. For example, the controller 108 may be communicatively coupled to the actuator 144 and is configured to control actuation of the actuator 144. As such, the controller 108 may be configured to position the suction valve 118 in an open position 402 (as illustrated in FIG. 6) or the closed position 304 via actuation of the actuator 144, which moves the rod 146 between retracted position and an extended position (or a second position). In some examples, the controller 108 sends one or more signals to the actuator 144 which causes the actuator 144 to extend or retract the rod 146, thereby causing the suction valve 118 to open or close. However, in some examples, the controller 108 may be manually operated by a user that operates the controller 108 to control operation of the unloading mechanism 142.

As described previously, the controller 108 receives driver speed data from the one or more sensors 106 of the prime mover 102. The driver speed data is indicative of a driver speed of the prime mover 102. The controller 108 may be configured to control operation of the unloading mechanism 142 based at least in part on the driver speed data. For example, the controller 108 is configured to allow the position of the suction valve 118 in the closed position 304 when the driver speed data indicates that the driver speed is substantially equal to or greater than the threshold driver speed. However, in some examples, the controller 108 may be manually operated by a user that operates the controller 108 to control operation of the unloading mechanism 142. In some instances, once the driver speed reaches the threshold driver speed, the prime mover 102 may be capable of driving operation of the pump 104 at a required torque, pump speed, pump rate, or other parameter. Once the controller 108 positions the suction valve 118 in the closed position while the pump 104 is operating, the suction valve 118 may resume "normal operation." Starting or winding down the prime mover 102 under a reduced load may significantly reduce fuel consumption, reduce electrical power requirements, and may extend a life of the prime mover 102 and/or pump 104, among other potential benefits.

FIG. 6 depicts a cross-sectional view of the fluid end 112 with the unloading mechanism 142 positioning the suction valve in the open position 402. In some examples, the unloading mechanism 142 is configured to maintain the suction valve 118 in and open position while the prime mover 102 starts up, winds down, or is otherwise operating below a threshold driver speed. Maintaining the suction valve 118 in the open position while the pump 104 operates permits fluid to circulate between the pump chamber 142 and the fluid intake manifold 122 (and/or the fluid source 120). As shown in FIG. 6, the unloading mechanism 142 includes the actuator 144 coupled to the rod 146 and configured to move the rod 146 between various positions. For example, the actuator 144 may retract the rod 146 which may cause the rod 146 to press against the suction valve 118, thereby lifting the suction valve 118 and positioning the suction valve 118 in the open position 402. As mentioned previously, when the actuator 144 moves the rod 146, the rod 146 may rotate around the joint 504, thereby causing the rod 146 to press against the suction valve 118.

In some examples, the controller 108 receives driver speed data from the one or more sensors 106 of the prime mover 102. The driver speed data is indicative of a driver speed of the prime mover 102. The controller 108 may be configured to control operation of the unloading mechanism 142 based at least in part on the driver speed data. For example, the controller 108 may be configured to position the suction valve 118 in the open position 402 when the driver speed data indicates that the driver speed is below a threshold driver speed. However, in some examples, the controller 108 may be manually operated by a user that operates the controller 108 to control operation of the unloading mechanism 142. In some instances, when the driver speed is below a threshold driver speed, the prime mover 102 may be starting up or winding down. As such, the controller 108 may open the suction valve 118 in order to unload the pump 104. For example, positioning the suction valve 118 in the open position 402 while the prime mover 102 starts up or winds down allows the prime mover 102 to start or wind down under a reduced load. For example, rather than having to pump fluid to a predetermined pressure to discharge fluid through the discharge valve 124, the fluid is circulated between the pump chamber 140 and the fluid intake manifold 122 (and/or the fluid source 120) as the plunger 110 moves in reciprocal motion within the plunger bore 138. Starting or winding down the prime mover 102 under a reduced load may significantly reduce fuel consumption, reduce electrical power requirements, and may extend a life of the prime mover 102 and/or pump 104, among other potential benefits.

Figure 7:
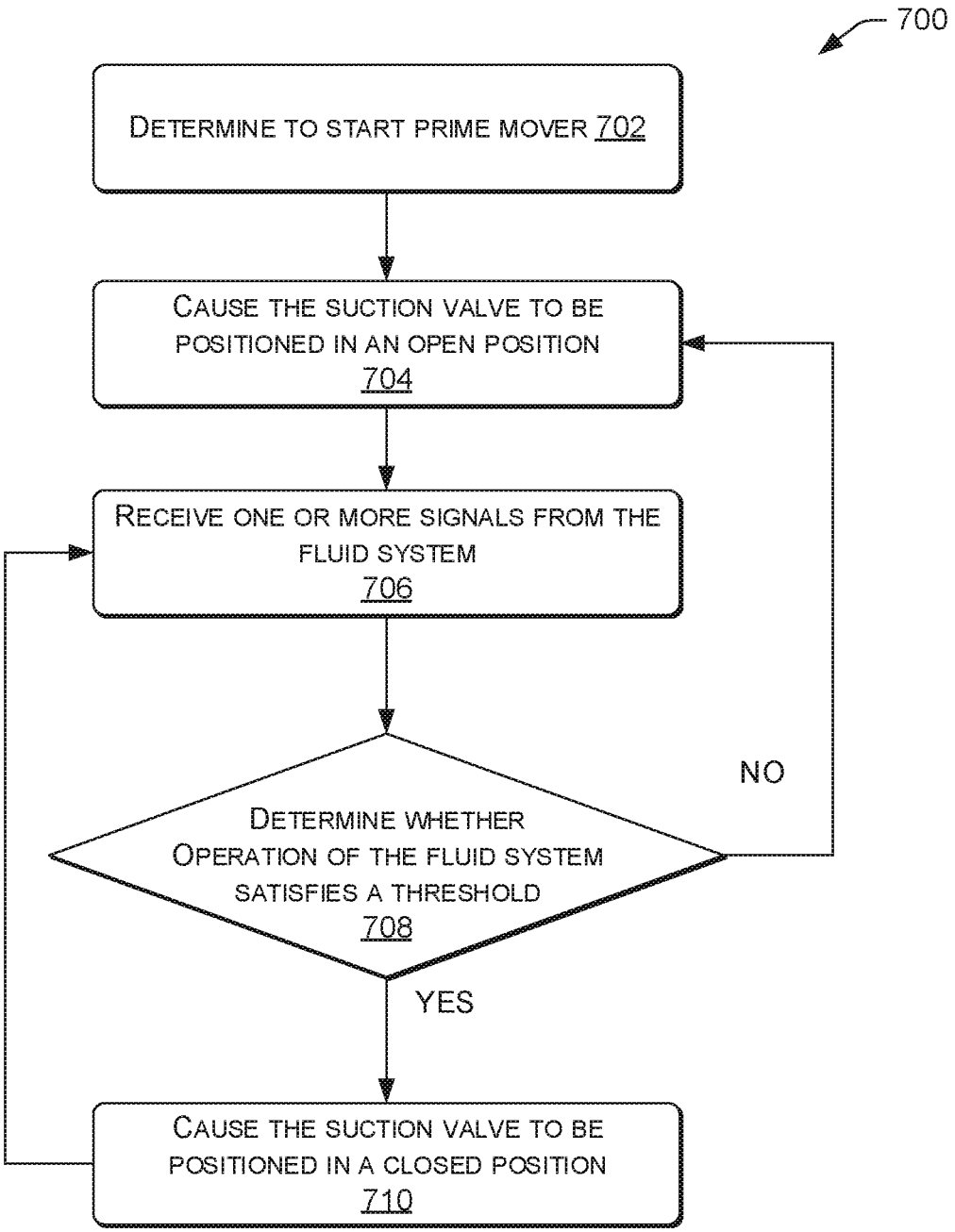
FIG. 7 is a flowchart illustrating a method of unloading a well stimulation pump, in accordance with an example of the present disclosure.

FIG. 7 illustrates an exemplary method for unloading a prime mover 102 configured to drive operation of a pump 104. The example method is illustrated as a collection of steps in a logical flow diagram, which represents operations that may be implemented in hardware, software, or a combination thereof. In the context of software, the steps represent computer-executable instructions stored in memory. Such computer-executable instructions may include routines, programs, objects, components, data structures, and the like that perform particular functions or implement particular abstract data types. The order in which the operations are described is not intended to be construed as a limitation, and any number of the described steps may be combined in any order and/or in parallel to implement the process. For discussion purposes, and unless otherwise specified, the method 700 is described with reference to the system 100, the prime mover 102, the pump 104, the one or more sensors 106, the controller 108, the fluid end 112 and the components thereof, and the unloading mechanism 142. In particular, and unless otherwise specified, the method 700 will be described below as being performed by the controller 108 for ease of description. Additionally, and/or alternatively, at least a portion of the method 700 may be performed by user input via the controller 108 and/or one or more user interfaces included on various components of the system 100. As mentioned previously, a user (such as an operator) may operate the controller 108 which may, in turn, be configured to operate an unloading mechanism 142 of the fluid system 100.

With reference to FIG. 7, at 702, the method 700 includes determining to start the prime mover 102. In some examples, a user may determine to start the prime mover 102 and may cause the prime mover 102 to start up. Additionally, or alternatively, the controller 108 (or another controller of the fluid system 100 such as a dedicated prime mover ECM, ECU, or other controller) receives instructions to start the prime mover 102. In some examples, a user may provide user input via a switch, user interface, or other selectable control that provides instructions to the controller 108 to start the prime mover 102. Additionally, or alternatively, the controller 108 may receive instructions to start the prime mover from a computing device that is configured to control at least a portion of a hydraulic fracturing process.

At 704, the method 700 includes causing the suction valve 118 to be positioned in the open position 402. In some examples, a user may operate or otherwise provide input to the controller 108 which causes the suction valve 118 to be positioned in the open position 402. In some examples, the controller 108 causes the suction valve 118 to be positioned in the open position 402 based at least in part on receiving instructions to start the prime mover 102. In some instances, causing the suction valve 118 to be positioned in the open position 402 includes sending, via the controller 108, one or more signals to the actuator 144. However, in some examples, the user may manually operate (e.g., via a switch, button, lever, or other control) the controller 108 to open the suction valve 118. As described previously, the actuator 144 is configured to actuate the rod 146 between various positions and the one or more signals may cause the actuator 144 to position the rod in a first position or a second position. In the first position, the rod 146 is disposed proximate and/or in contact with the suction valve 118 and the suction valve 118 is in the closed position 304. In the second position, the actuator 144 actuates the rod 146 to press against the suction valve 118 positioning the suction valve 118 in the open position 402. As such, when the controller 108 positions the suction valve 118 in the open position 402, the controller 108 may send one or more signals to the actuator 144 causing the actuator 144 to actuate the rod 146 into the second position, which causes the rod 146 to abut the suction valve 118, thereby causing the suction valve 118 to be positioned in the open position 402.

At 706, the controller 108 receives one or more signal from the fluid system 100. For example, the controller 108 may receive one or more signals indicative of driver speed data from the one or more sensors 106 of the prime mover 102. In some examples, the driver speed data represents a rotational speed of a drive shaft of the prime mover 102 and may be represented in revolutions per minute (RPM). However, in some examples, the one or more signals represent one or more parameters associated with vibration (associated with the fluid end 112, the pump 104, and/or the prime mover 102), pressure (associated with the fluid end 112 and/or the pump 104), or one or more other parameters associated with the fluid system 100.

At 708, the controller 108 determines whether operation of the fluid system 100 satisfies a threshold. For example, the controller 108 may determine whether the driver speed of the prime mover 102 is substantially equal to or greater than a threshold driver speed. As described herein, "substantially equal to" may mean that the driver speed is within: approximately 50 RPM of the threshold driver speed, approximately 100 RPM of the threshold driver speed, approximately 250 RPM of the threshold driver speed, or approximately 500 RPM of the threshold driver speed. Additionally, and/or alternatively, the controller 108 may determine, at 708, whether one or more of the parameters previously mentioned (e.g., vibration, pressure, or other parameters) satisfy a threshold value. In some examples, the controller 108 may determine whether multiple parameters satisfy multiple respective thresholds and may control operation (either automatically, semi-automatically, or manually via user input) of the unloading mechanism based on determining whether the multiple parameters satisfy their respective threshold values.

If the controller 108 determines at 708 that operation of the fluid system 100 does not satisfy the threshold (Step: 708—No), the process 700 returns to 704 and the controller 108 maintains the open position 402 of the suction valve 118. In some examples, the controller 108 may continue to receive one or more signals from the fluid system 100 at 706 and determine whether the operation of the fluid system 100 satisfies the threshold at 708.

If, however, the controller 108 determines at 708 that operation of the fluid system 100 satisfies the threshold (Step: 708—Yes), the process 700 proceeds to 710 where the method 700 includes causing the suction valve 118 to be positioned in the closed position 304. In some examples, causing the suction valve 118 to be positioned in the closed position 304 includes sending, via the controller 108, one or more signals to the actuator 144. In some examples, a user may operate or otherwise provide input to the controller 108 which causes the suction valve 118 to be positioned in the closed position 304. In either example, the controller 108 may cause the actuator 144 to actuate the rod 146 to position the rod 146 in the first position. In the first position, the rod 146 is disposed proximate and/or in contact with the suction valve 118 and the suction valve 118 is positioned in the closed position 304. As described previously, when the rod 146 is positioned in the first position, the suction valve 118 resumes "normal operation" as the pump 104 continues to operate.

As shown in FIG. 7, the controller 708 may continue to receive one or more signals from the fluid system 100 once the suction valve 118 is positioned in the closed position 304. The controller 108 may continue to monitor operation of the fluid system 100 and determine whether the operation of the fluid system 100 satisfies a threshold at 708. The controller 108 may also position the suction valve 118 in the open position if the fluid system 100 fails to satisfy the threshold.

INDUSTRIAL APPLICABILITY

The present disclosure provides a system and mechanism for unloading a pump during start up or wind down of a prime mover that drives the pump. The system can be used in a variety of applications. For example, the system is used in gas, oil, and hydraulic fracturing applications. The system includes an unloading mechanism that maintains an open position of a valve within a fluid end to unload a pump during start up or wind down of the prime mover that drives the pump. Starting or winding down the prime mover with the valve open in the fluid end reduces a load imparted on the prime mover as the prime mover drives the pump. Furthermore, starting or winding down the prime mover under a reduced load can significantly reduce fuel consumption, reduce electrical power requirement and/or can extend a life of the prime mover and/or the pump.

According to some embodiments, the system 100 includes a controller 108 configured to position a suction valve 118 in an open position 402 or a closed position 304. The controller 108 positions the suction valve 118 in the open position 402 or the closed position 304 while a prime mover 102 and a pump 104 are operating. The controller 108 is communicatively coupled to an unloading mechanism 142 that positions the suction valve 118 in a position. The unloading mechanism 142 includes an actuator 144 that actuates a rod 146 between various positions in order to lift the suction valve 118 or allow the suction valve 118 to be seated on a suction valve seat 302. The controller 108 is configured to position the suction valve 118 in the open position 402 when the driver speed is below a threshold driver speed and to position the suction valve in the closed position 304 when the driver speed is substantially equal to or greater than the threshold driver speed.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system, comprising:

a fluid end including:

a block;

a suction bore formed in the block;

a suction valve seat disposed within the suction bore;

a suction valve disposed within the suction bore, the suction valve, in a closed position, being configured to contact the suction valve seat to seal the suction bore; and a rod that is moveable between a first position and a second position; and a controller configured to:

determine, based at least in part on driver speed data indicative of a driver speed of a prime mover coupled to a hydraulic fracturing pump that includes the system, whether the driver speed, of the prime mover coupled to the hydraulic fracturing pump, satisfies a threshold;

cause, when the driver speed, of the prime mover coupled to the hydraulic fracturing pump, does not satisfy the threshold, hydraulic fracturing fluid to flow from a pump chamber of the hydraulic fracturing pump to a fluid intake manifold of the hydraulic fracturing pump by causing the rod to engage the suction valve in the second position; and cause the rod to retract, into the first position, when the driver speed satisfies the threshold, wherein:

the rod is configured to be in the first position when the suction valve is in the closed position, and the rod is configured to be in the second position when engagement of the rod with the suction valve causes the suction valve to be in an open position.

2. The system of claim 1, further comprising an actuator configured to actuate the rod between the first position and the second position.

3. The system of claim 2, wherein the controller is communicatively coupled to the actuator, and wherein the controller is configured to cause the actuator to position the rod in the second position.

4. The system of claim 1, wherein the fluid end further includes a plunger bore formed in the block, wherein the system comprises:

the hydraulic fracturing pump; and the prime mover, the hydraulic fracturing pump having a plunger disposed at least partially within the plunger bore, the prime mover being configured to drive operation of the hydraulic fracturing pump, and the prime mover including a driver speed sensor configured to generate the driver speed data, and wherein the controller is communicatively coupled to the prime mover and the driver speed sensor, and wherein the controller is further configured to receive the driver speed data.

5. The system of claim 1, wherein, to cause the rod to retract, the controller is configured to:

determine that the driver speed, of the prime mover coupled to the hydraulic fracturing pump, is equal to or greater than the threshold; and cause the rod to be positioned in the first position based at least in part on determining that the driver speed, of the prime mover coupled to the hydraulic fracturing pump, is equal to or greater than the threshold.

6. The system of claim 1, wherein the fluid end further comprises:

one or more other suction valves; and one or more other rods that correspond to the one or more other suction valves.

7. The system of claim 6, further comprising:

multiple actuators corresponding to the rod and the one or more other rods.

8. The system of claim 7, wherein the controller is configured to control the multiple actuators.

9. The system of claim 1, wherein the fluid end further includes one or more other suction valves, and wherein the controller is configured to close or open the suction valve and the one or more other suction valves in a specific sequence in order to reduce a rate of load being applied to the prime mover.

10. A method, comprising:

determining, based at least in part on driver speed data indicative of a driver speed of a prime mover coupled to a fracturing pump, whether the driver speed, of the prime mover coupled to the fracturing pump, satisfies a threshold;

causing, when the driver speed, of the prime mover coupled to the fracturing pump, does not satisfy the threshold, fracturing fluid to circulate between one or more respective pump chambers of the fracturing pump and a fluid manifold by positioning one or more suction valves in an open position; and causing, when the driver speed satisfies the threshold, the one or more suction valves to be positioned in a closed position, wherein the one or more suction valves prevent flow from the one or more respective pump chambers to the fluid manifold when the one or more suction valves are in the closed position.

11. The method of claim 10, wherein positioning the one or more suction valves in the open position includes:

causing, via a controller, one or more actuators to position one or more rods to engage the one or more suction valves to position the one or more suction valves in the open position.

12. A system comprising:

a fracturing pump;

a prime mover coupled to the fracturing pump; and a controller configured to:

determine, based at least in part on driver speed data indicative of a driver speed of the prime mover, whether the driver speed satisfies a threshold; and cause fracturing fluid to flow from a pump chamber of the fracturing pump to a fluid intake manifold of the fracturing pump by causing a suction valve, of the fracturing pump, to be positioned in an open position for an amount of time until the driver speed satisfies the threshold, the suction valve being configured to be substantially static in the open position for the amount of time; and allow the suction valve to be positioned in a closed position after the driver speed satisfies the threshold.

13. The system of claim 12, further comprising:

a rod disposed adjacent the suction valve; and an actuator configured to actuate the rod, wherein the rod is configured to press against the suction valve to position the suction valve in the open position.

14. The system of claim 12, wherein the amount of time is a time between starting the prime mover and the driver speed reaching the threshold.

15. The system of claim 12, further comprising:

a rod disposed adjacent the suction valve, wherein, allowing the suction valve to be positioned in the closed position, the controller is configured to:

cause the rod to position the suction valve in the closed position when the driver speed is equal to or greater than the threshold.

16. The system of claim 12, wherein the prime mover is a diesel engine or a natural gas engine.

17. The system of claim 12, wherein the prime mover is configured to drive operation of the fracturing pump at a required torque or a required speed when the driver speed satisfies the threshold.

18. The system of claim 1, wherein the driver speed, of the prime mover coupled to the hydraulic fracturing pump, is a rotational speed of a drive shaft of the prime mover coupled to the hydraulic fracturing pump, and wherein, to determine whether the driver speed, of the prime mover coupled to the hydraulic fracturing pump, satisfies the threshold, the controller is further configured to:

determine whether the driver speed, of the prime mover coupled to the hydraulic fracturing pump, is within 50 revolutions per minute (RPM) of the threshold.

19. The system of claim 1, wherein, to cause the rod to retract, into the first position, when the driver speed satisfies the threshold, the controller is further configured to:

cause the rod to retract, into the first position, based on determining that the driver speed satisfies the threshold, wherein the controller is further configured to:

determine that the driver speed, of the prime mover coupled to the hydraulic fracturing pump, does not satisfy the threshold after determining that the driver speed, of the prime mover coupled to the hydraulic fracturing pump, satisfies the threshold and after causing the rod to retract into the first position, and wherein, to cause, when the driver speed, of the prime mover coupled to the hydraulic fracturing pump, does not satisfy the threshold, the hydraulic fracturing fluid to flow from the pump chamber of the hydraulic fracturing pump to the fluid intake manifold of the hydraulic fracturing pump, the controller is further configured to:

cause, after causing the rod to retract into the first position and based on determining that the driver speed, of the prime mover coupled to the hydraulic fracturing pump, does not satisfy the threshold, the hydraulic fracturing fluid to flow from the pump chamber of the hydraulic fracturing pump to the fluid intake manifold of the hydraulic fracturing pump.

20. The method of claim 10, further comprising:

causing the one or more suction valves to be positioned in the open position after causing the one or more suction valves to be positioned in the closed position.

* * * * *